US007956810B2

(12) United States Patent
Su et al.

(10) Patent No.: US 7,956,810 B2
(45) Date of Patent: Jun. 7, 2011

(54) ANTENNA DEVICE AND ANTENNA SYSTEM UTILIZING SAID ANTENNA DEVICE

(75) Inventors: Saou-Wen Su, Taipei (TW); Jui-Hung Chou, Tai-Chung (TW)

(73) Assignees: Silitek Electronic (Guangzhou) Co., Ltd., Guangzhou (CN); Lite-On Technology Corp., Taipei (TW)

( * ) Notice: Subject to any disclaimer, the term of this patent is extended or adjusted under 35 U.S.C. 154(b) by 661 days.

(21) Appl. No.: 12/042,336

(22) Filed: Mar. 5, 2008

(65) Prior Publication Data

US 2009/0128421 A1 May 21, 2009

(30) Foreign Application Priority Data

Nov. 15, 2007 (TW) ..... 96143256 A

(51) Int. Cl.
*H01Q 1/36* (2006.01)

(52) U.S. Cl. ..... 343/700 R

(58) Field of Classification Search ..... 343/702, 343/700 MS, 803, 833–834, 846
See application file for complete search history.

(56) References Cited

U.S. PATENT DOCUMENTS

| | | | | |
|---|---|---|---|---|
| 5,394,160 | A * | 2/1995 | Iwasaki et al. | 343/702 |
| 6,515,627 | B2 * | 2/2003 | Lopez et al. | 343/700 MS |
| 7,167,132 | B2 * | 1/2007 | Tamaoka | 343/702 |
| 7,602,340 | B2 * | 10/2009 | Sato | 343/700 MS |
| 7,623,087 | B2 * | 11/2009 | Higaki et al. | 343/909 |
| 2002/0163471 | A1 * | 11/2002 | Lopez et al. | 343/702 |
| 2009/0046019 | A1 * | 2/2009 | Sato | 343/702 |

FOREIGN PATENT DOCUMENTS

| | | |
|---|---|---|
| TW | M253071 | 12/2004 |
| TW | I227953 | 2/2005 |

* cited by examiner

*Primary Examiner* — Huedung Mancuso
(74) *Attorney, Agent, or Firm* — Kile Goekjian Reed & McManus PLLC

(57) ABSTRACT

An antenna device includes a first conductive piece, a second conductive piece, a third conductive piece and a feeding point. The second conductive piece is electrically coupled to a predetermined voltage level. The third conductive piece is electrically connected to the first conductive piece and the second conductive piece. The feeding point is located on the first conductive piece.

14 Claims, 9 Drawing Sheets

ANTENNA DEVICE AND ANTENNA SYSTEM UTILIZING SAID ANTENNA DEVICE

BACKGROUND OF THE INVENTION

1. Field of the Invention

The present invention relates to an antenna device and an antenna system utilizing said antenna device, and particularly relates to a wideband antenna that can be hidden in a system and a wideband antenna system utilizing said wideband antenna device.

2. Description of the Prior Art

A popular type of a access-point antenna applied to a wireless wideband router/hub is a dipole antenna with a plastic or rubber sleeve encircling it. The dipole antenna is always located at one side of an apparatus, and the antenna is exposed on the case of a product. Such an antenna is prone to be vandalized, occupies a lot of space and affects the aesthetics, and it is even worse for a multi-antenna system where there are more than two antennas. FIG. 1 is a schematic diagram illustrating a prior art wideband router 100. As shown in FIG. 1, the wideband router 100 includes antennas 101, 103 and 105, but the antennas 101, 103 and 105 are exposed and have considerable sizes such that the antennas can easily be damaged by external force.

In order to solve these problems, some access-point antennas have been developed to be smaller and at the same time capable of providing wide bandwidth (2.4~5.8 GHz). For example, a Taiwan patent with patent number M253071 discloses a "dual-band antenna", which utilizes a dual-band access-point dipole antenna structure. The antenna utilizes two radiating copper tubes to reach the 2.4 and 5 GHz dual-band operation, and this operation is different from a prior art single band dipole antenna that utilizes a center conducting line of the coaxial cable. Additionally, a Taiwan patent I227953 discloses a "broadband dipole antenna", which discloses a broadband access-point dipole antenna structure. The antenna includes two metal sleeves and a radiating metal line. By controlling the relative positions of both metal sleeves and the radiating metal line, good impedance matching in the 2.4-5.8 GHz band can be obtained, leading to a wideband operation. However, for the above-mentioned antennas, there is still a need for an extra plastic/rubber sleeve to wrap around the antenna, which causes an increase in the complexity and antenna cost. Furthermore, such antennas cannot be hidden inside a wireless wideband router/hub; that is, the antenna must be external, and therefore the aesthetics of the product decreases.

Therefore, a new invention is needed to solve the related problems.

SUMMARY OF THE INVENTION

One objective of the present invention is to provide an antenna device, which can be formed by bending or constituting conductive pieces, such that the size of the antenna device decreases and the fabrication process can be simplified.

Another objective of the present invention is to provide an antenna system, which includes a plurality of antenna devices that can be hidden in a system. Also, the antenna devices are arranged according to specific rules, improving the communication efficiency of the antenna system.

One embodiment of the present invention discloses an antenna device that comprises a first conductive piece, a second conductive piece electrically connected to a predetermined voltage level, a third conductive piece electrically connected to the first conductive piece and the second conductive piece, and a feeding point located on the first conductive piece.

Another embodiment of the present invention discloses an antenna system, comprising a supporting base electrically connected to a predetermined voltage level, and at least one antenna device located on the supporting base. The antenna device comprises a first conductive piece, a second conductive piece electrically connected to the supporting base, a third conductive piece electrically connected to the first conductive piece and the second conductive piece, and a feeding point located on the first conductive piece.

With the above-mentioned structures, the lowest operating frequency of the antenna can be decreased. Also, the size of the antenna can be reduced, so that the antenna can be hidden inside the system. Moreover, the antenna devices mentioned above can be formed by stamping or cutting a single metal plate, further decreasing manufacture cost.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
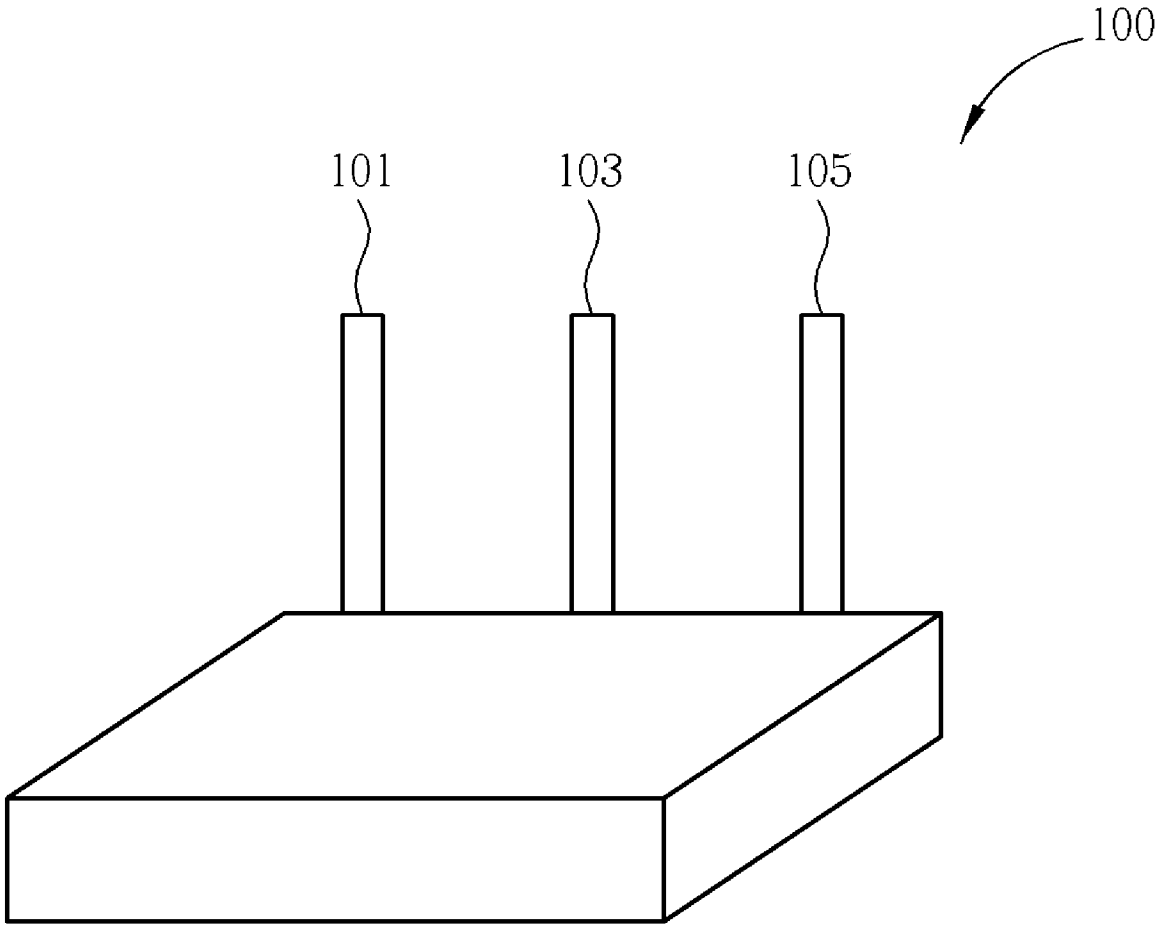
FIG. 1 is a schematic diagram illustrating a prior art wideband router.
Figure 2:
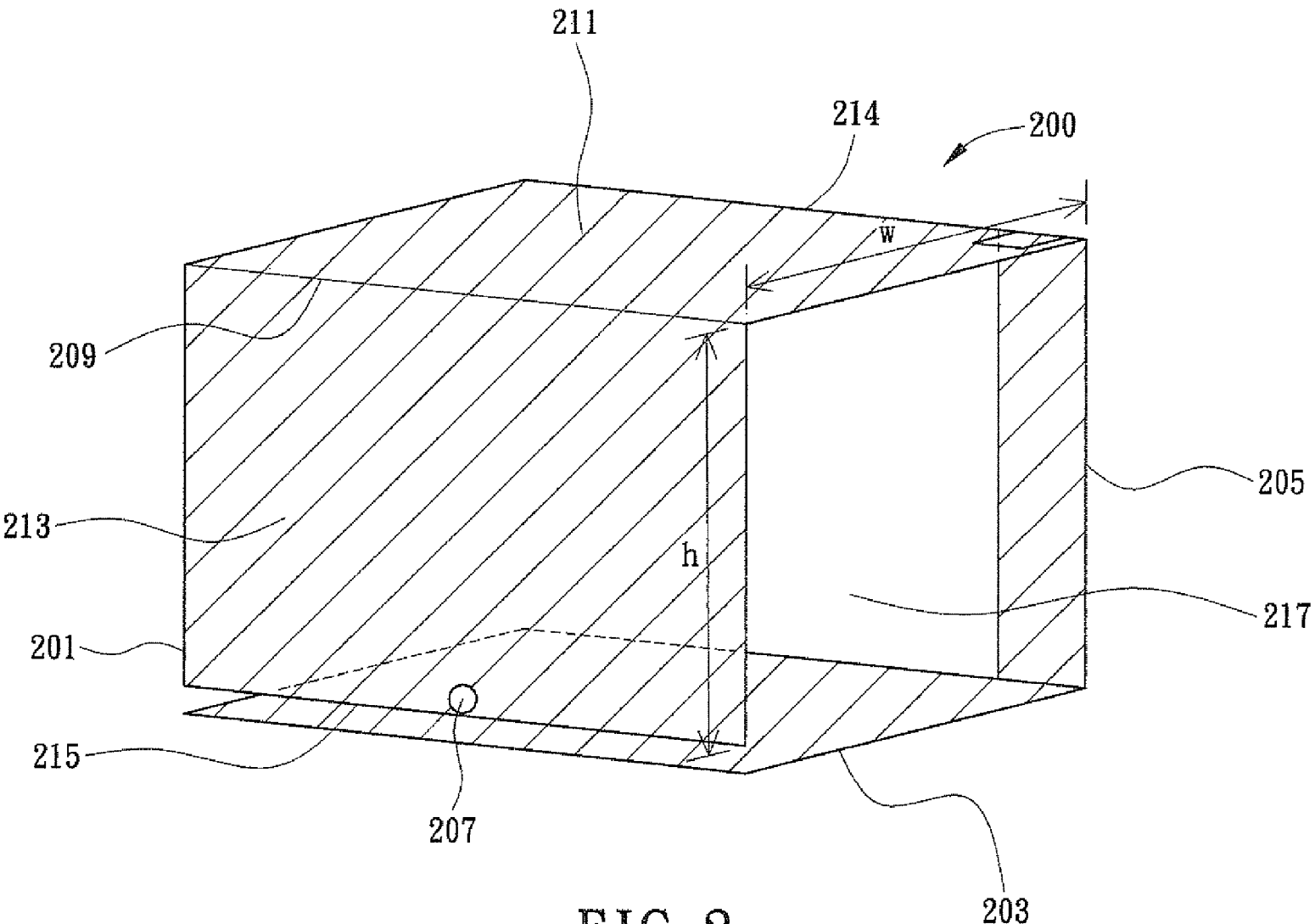
FIG. 2 is a perspective view of an antenna device according to a first embodiment of the present invention.
Figure 3:
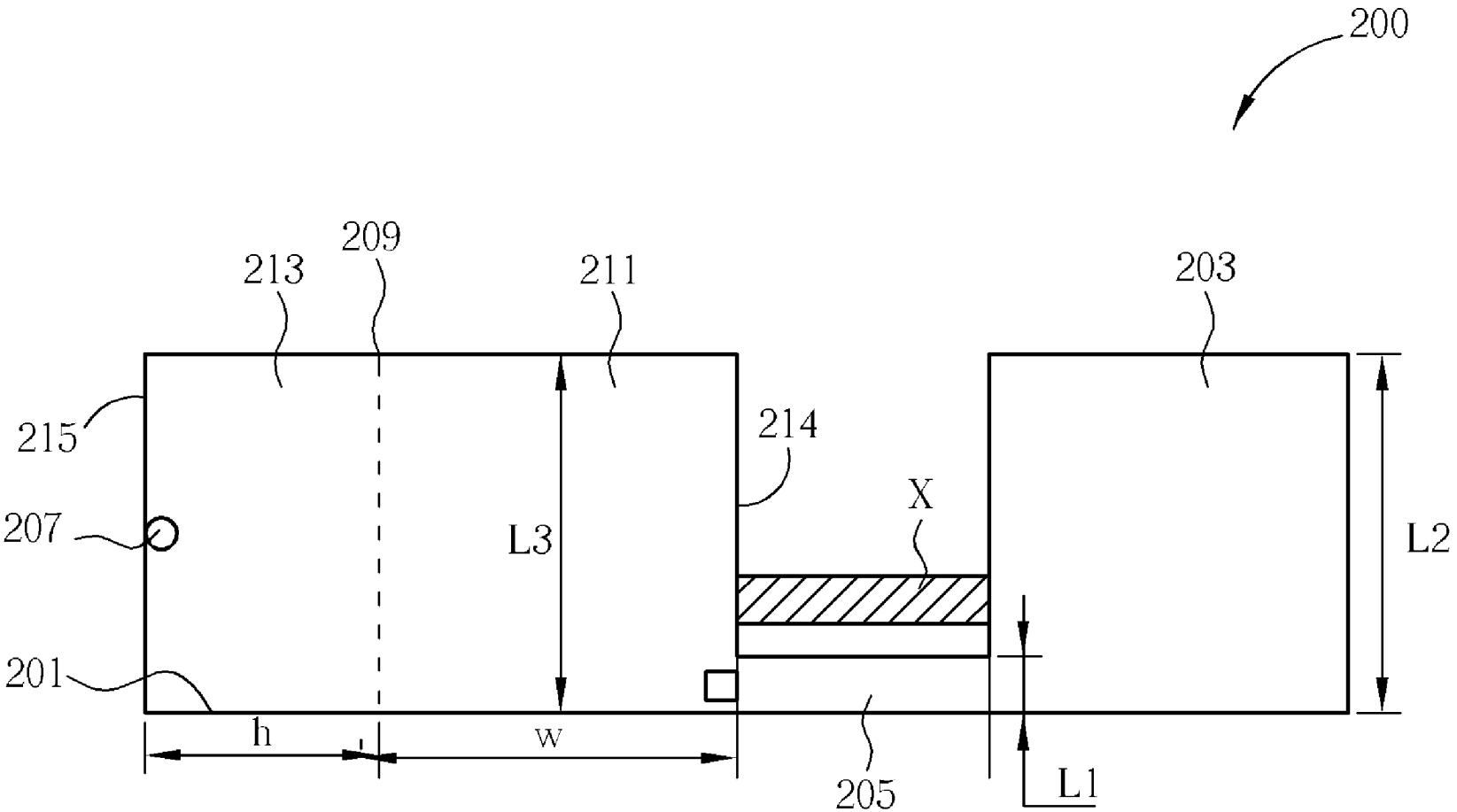
FIG. 3 is an expanded view of an antenna device according to a first embodiment of the present invention.

FIG. 2 is a perspective view of an antenna device 200, which is also named a radiating device, according to a first embodiment of the present invention. As shown in FIG. 2, the antenna device 200 according to a first embodiment of the present invention includes a first metal piece 201, a second metal piece 203, a third metal piece 205 and a feeding point 207. The first metal piece 201 includes a bending part 209. The second metal piece 203 is electrically coupled to ground (i.e., a predetermined voltage level). The feeding point 207 is located at the first metal piece 201. FIG. 3 is an expanded view of an antenna device 200 according to a first embodiment of the present invention. Please jointly refer to FIG. 2 and FIG. 3 to understand the antenna device structure according to embodiments of the present invention.

In this embodiment, the bending part 209 separates the first metal piece 201 into a first part 211 and a second part 213. The second metal piece 203 is substantially parallel to the first part 211 and is substantially perpendicular to the second part 213. Also, the first metal piece 201 includes a first side 214 and a second side 215, wherein the first side 214 is electrically connected to the third metal piece 205, and the second side 215 is toward the second metal piece 203 but is not electrically connected to the second metal piece 203. The feeding point 207 is located on the second side 215. Additionally, a material 217, which has a dielectric constant substantially equal to that of the air in one embodiment, can be provided between the first metal piece 201 and the second metal piece 203. Furthermore, the third metal piece 205 is electrically connected to a part of the first metal piece 201 and a part of the second metal piece 203. That is, a length $L_1$ of the third metal piece 205 is smaller than a length $L_3$ of the first metal piece 201 and a length $L_2$ of the second metal piece 205. Furthermore, the second metal piece 203 and the third metal piece 205 are formed by stamping or cutting a single metal plate, decreasing the cost of manufacture. Additionally, a distance between the first side 214 and the second side 215 (i.e., the sum of a width w of the antenna device and a height of the second part 213) is determined according to a lowest operating frequency of the antenna device.

Furthermore, a distance between the bending part 209 and the second side 215 (i.e., the height h of the second part 213) substantially determines the impedance matching of the antenna device 200 over the operating bandwidth.

Figure 4:
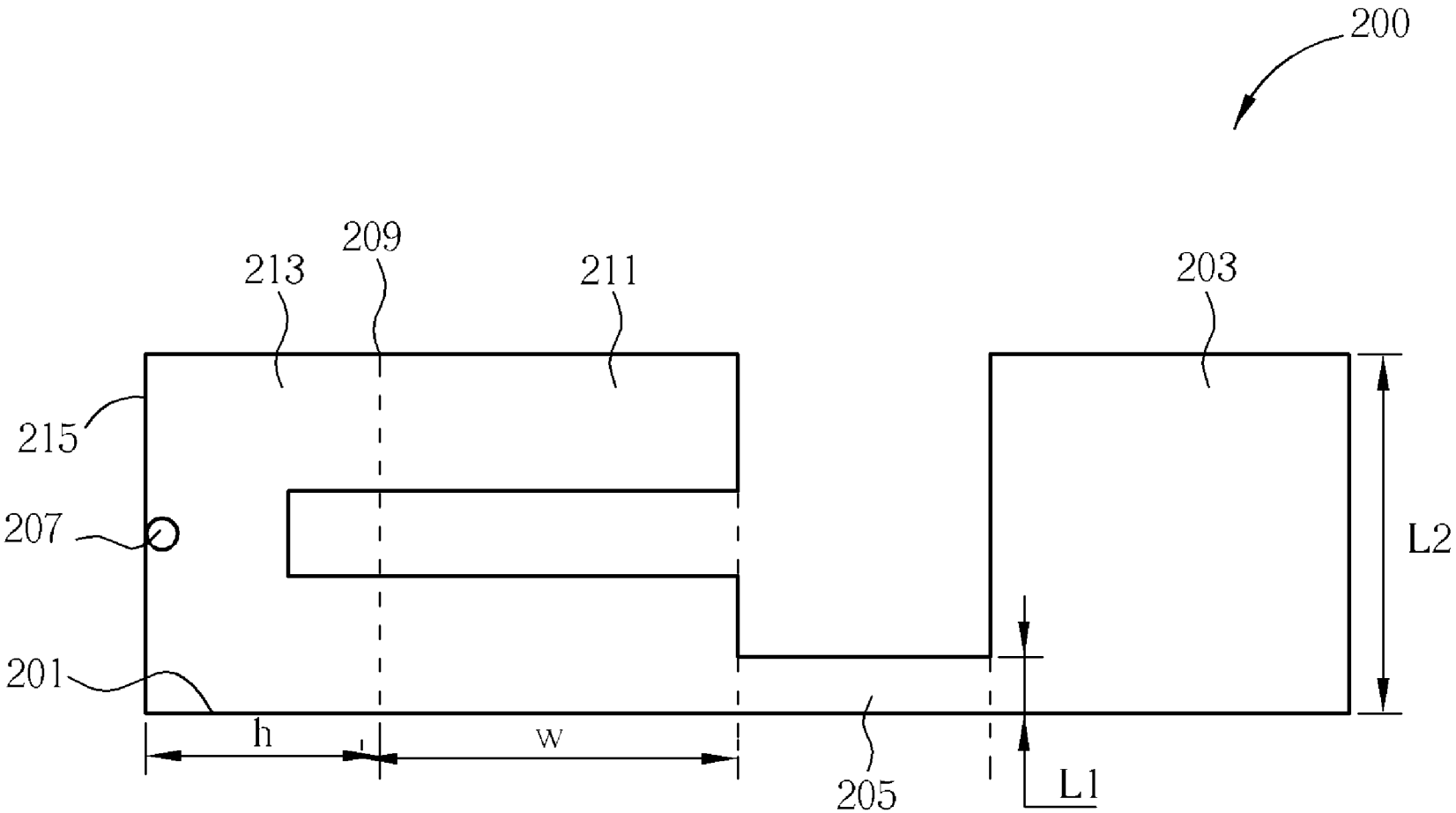
FIG. 4 is an expanded view of an antenna device according to a second embodiment of the present invention.
Figure 5:
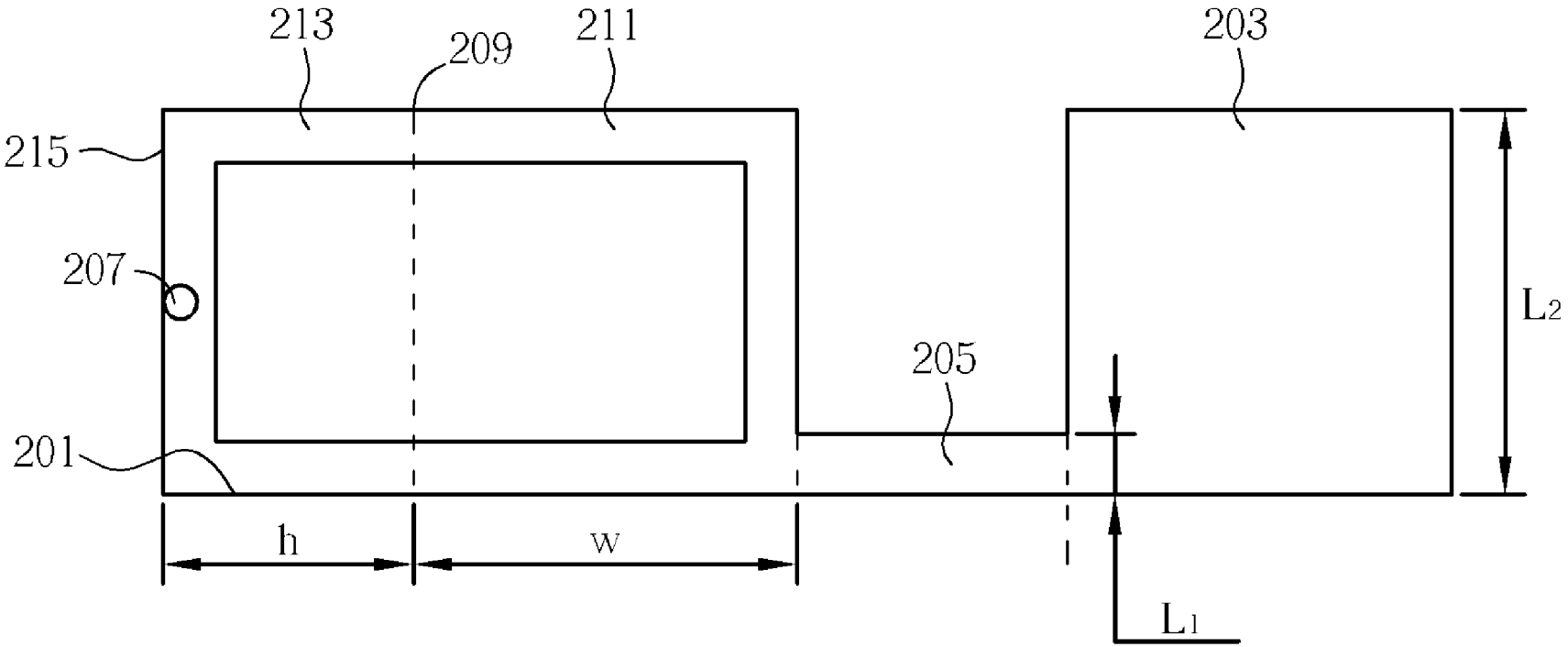
FIG. 5 is an expanded view of an antenna device according to a third embodiment of the present invention.

It should be noted that the above-mentioned description is only an example and does not mean to limit the scope of the present invention. For example, FIG. 4 is an expanded view of an antenna device according to a second embodiment of the present invention, and the first metal piece 201 is a U-shaped metal piece in FIG. 4 instead of a rectangle shown in FIG. 3. Additionally, FIG. 5 is an expanded view of an antenna device according to a third embodiment of the present invention, and the first metal piece 201 is a ring shaped metal piece in FIG. 5. Besides, in the above mentioned FIG. 2 to FIG. 5, the metal piece 201 can include other numbers of bending parts (0 or more than one) instead of just one bending part. Additionally, the structural relation of the third metal piece 205 relative to the first metal piece 201 and the second metal piece 203 is not limited to that shown in FIG. 2 and FIG. 3. For example, the third metal piece 205 can be moved to the location X, as shown in FIG. 3, and the embodiments shown in FIG. 4 and FIG. 5 can have the same or similar variations. Also, other conductive materials can substitute first, second and third metal pieces to reach the same function. Persons skilled in the art can amend the structures of the antenna device according to the disclosure of the present invention to reach the same function. Such variations should also fall in the scope of the present invention.

Figure 6:
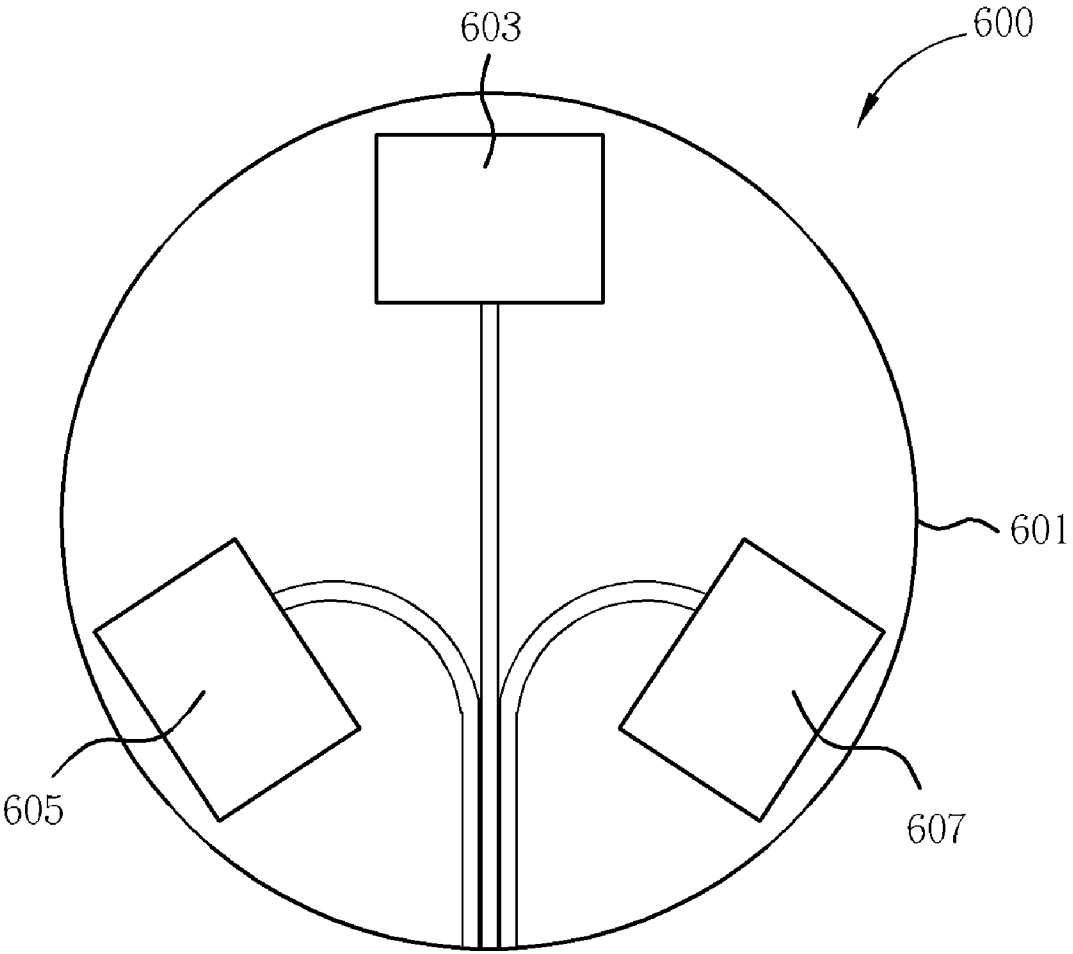
FIG. 6 illustrates an antenna system according to an embodiment of the present invention.

FIG. 6 illustrates an antenna system 600 according to an embodiment of the present invention. As shown in FIG. 6, the antenna system includes a supporting base 601 and a plurality of antenna devices 603, 605 and 607, wherein the structures of the antenna devices 603, 605 and 607 are as shown in FIG. 2 to FIG. 5. In this embodiment, the supporting base 601 is a circle metal piece coupled a ground level (i.e. a predetermined voltage level). Additionally, the antenna devices 603, 605 and 607 are located on the supporting base 601 and are substantially equidistant from each other, and the third conductive piece 205 of the antenna device faces a geometric center (the center of the circle in this embodiment) of the supporting base 601, thereby decreasing the port isolation among the antenna devices 603, 605 and 607. Furthermore, the second metal piece 203 of the antenna devices 603, 605 and 607 is electrically connected or coupled to the supporting base 601. It should be noted that the figures and the description shown in the antenna system 600 according to the embodiment of the present invention are only examples and are not meant to limit the scope of the present invention. For example, the antenna device does not necessary need to be located at the supporting base, and can be located on the computer chassis to be connected to ground. Also, the supporting base 601 is not limited to being a circle metal piece, and the arrangement of the antenna devices is not limited to being as shown in FIG. 6.

Figure 7:
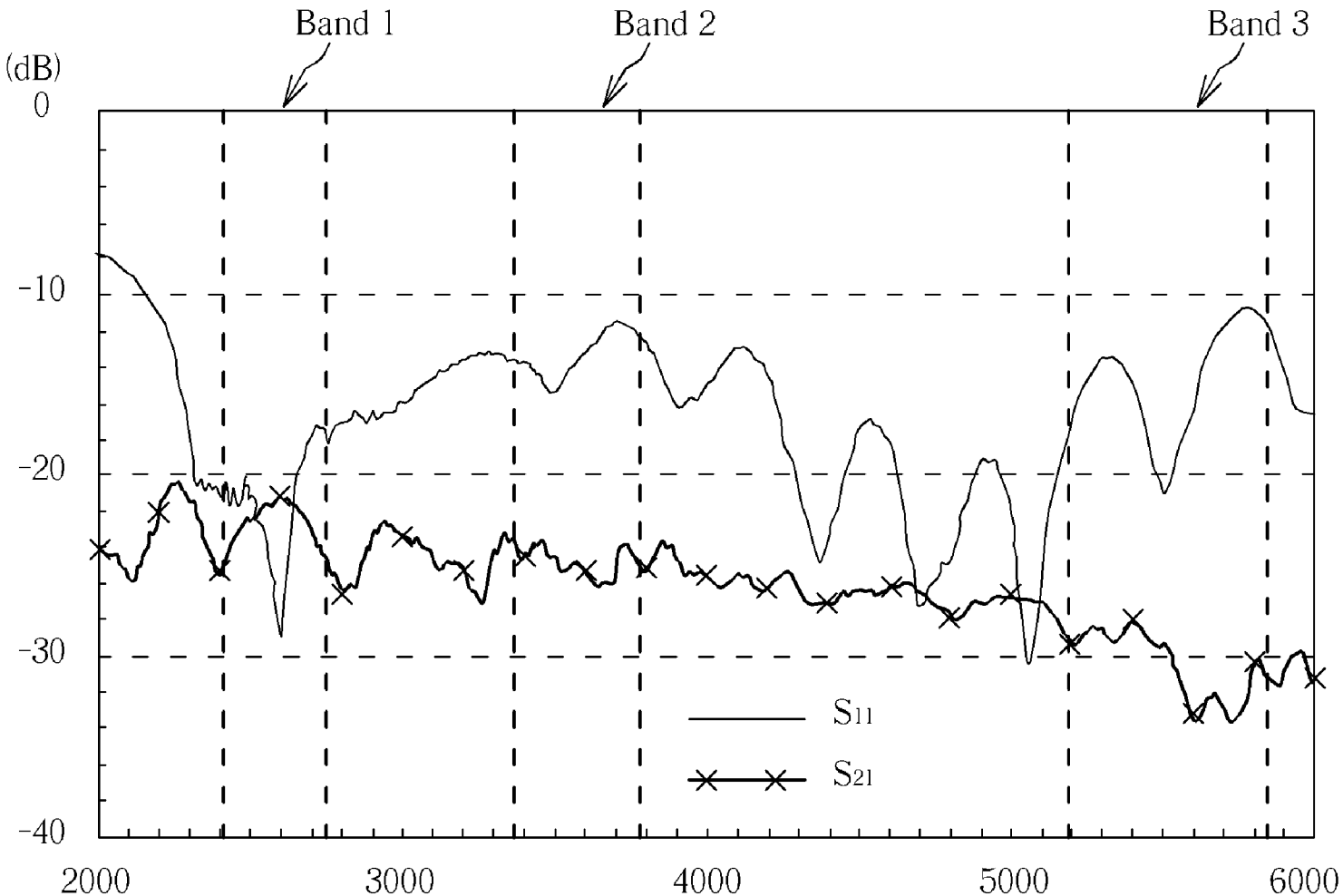
FIG. 7 illustrates the reflection coefficient and isolation coefficient of an antenna device according to an embodiment of the present invention.

FIG. 7 illustrates the reflection coefficient $S_{11}$ and isolation coefficient $S_{21}$ of the antenna device according to an embodiment of the present invention. Bands 1, 2, and 3 represent the WLAN and/or WiMAX bands of 2400-2690 MHz, 3400-3800 MHz, and 5150-5850 MHz, respectively. From FIG. 7, it is clear that the obtained −10 dB impedance bandwidth easily covers the entire band of 2400-5850 MHz, which meets the required operating bandwidth for WLAN and/or WiMAX operation. Furthermore, the isolation coefficient $S_{21}$ remains under −20 dB over the operating band.

Figure 8:
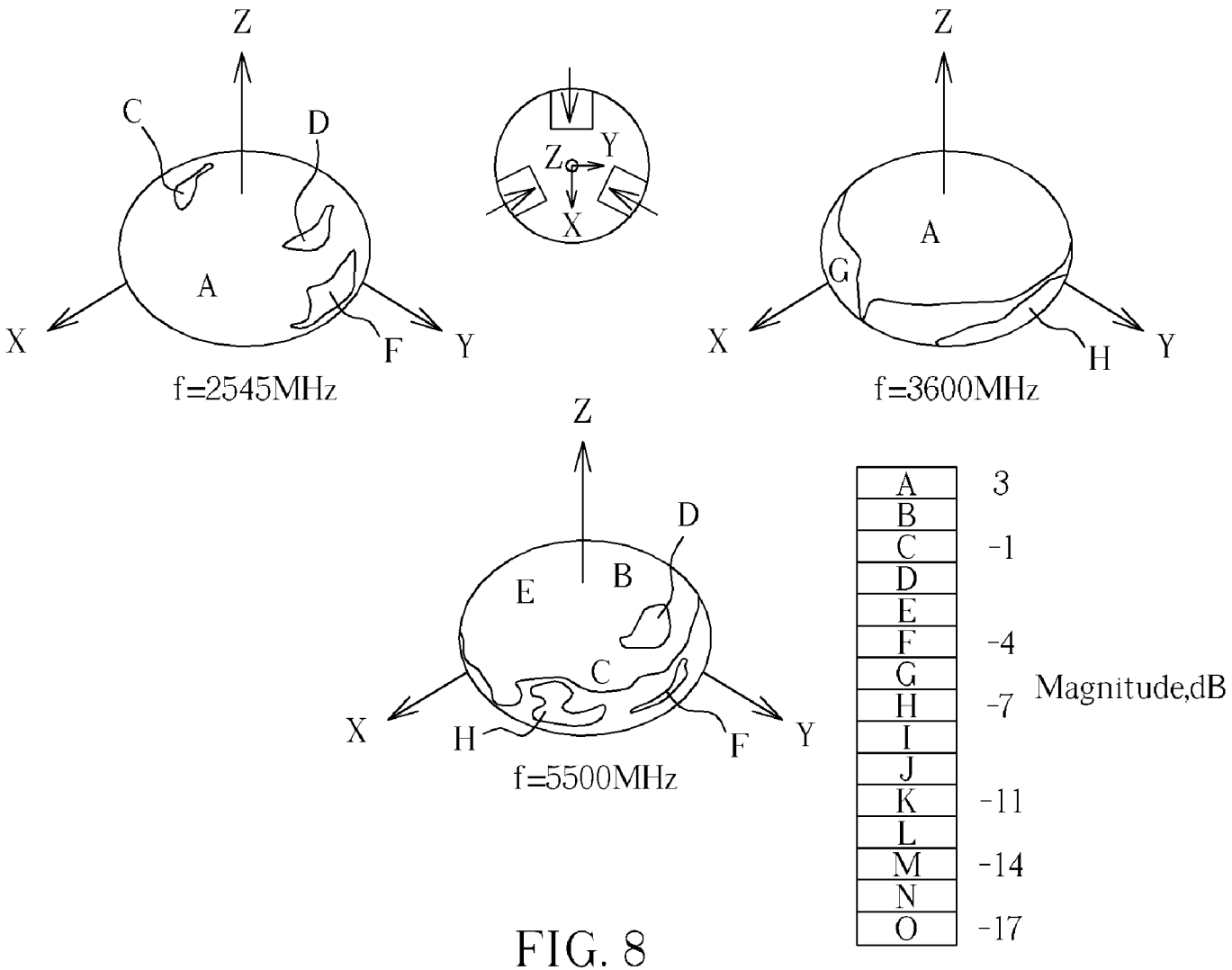
FIG. 8 illustrates a measured 3-D radiation pattern of an antenna device according to an embodiment of the present invention.

FIG. 8 illustrates a measured 3-D radiation pattern of an antenna device according to an embodiment of the present invention. As shown in FIG. 8, the radiation patterns of the antenna system of the present invention are very similar, with no non-signal region, and are of omnidirectional characteristics. ABC . . . O indicate different field intensities, and FIG. 8 illustrates the distribution of the field intensity.

Figure 9:
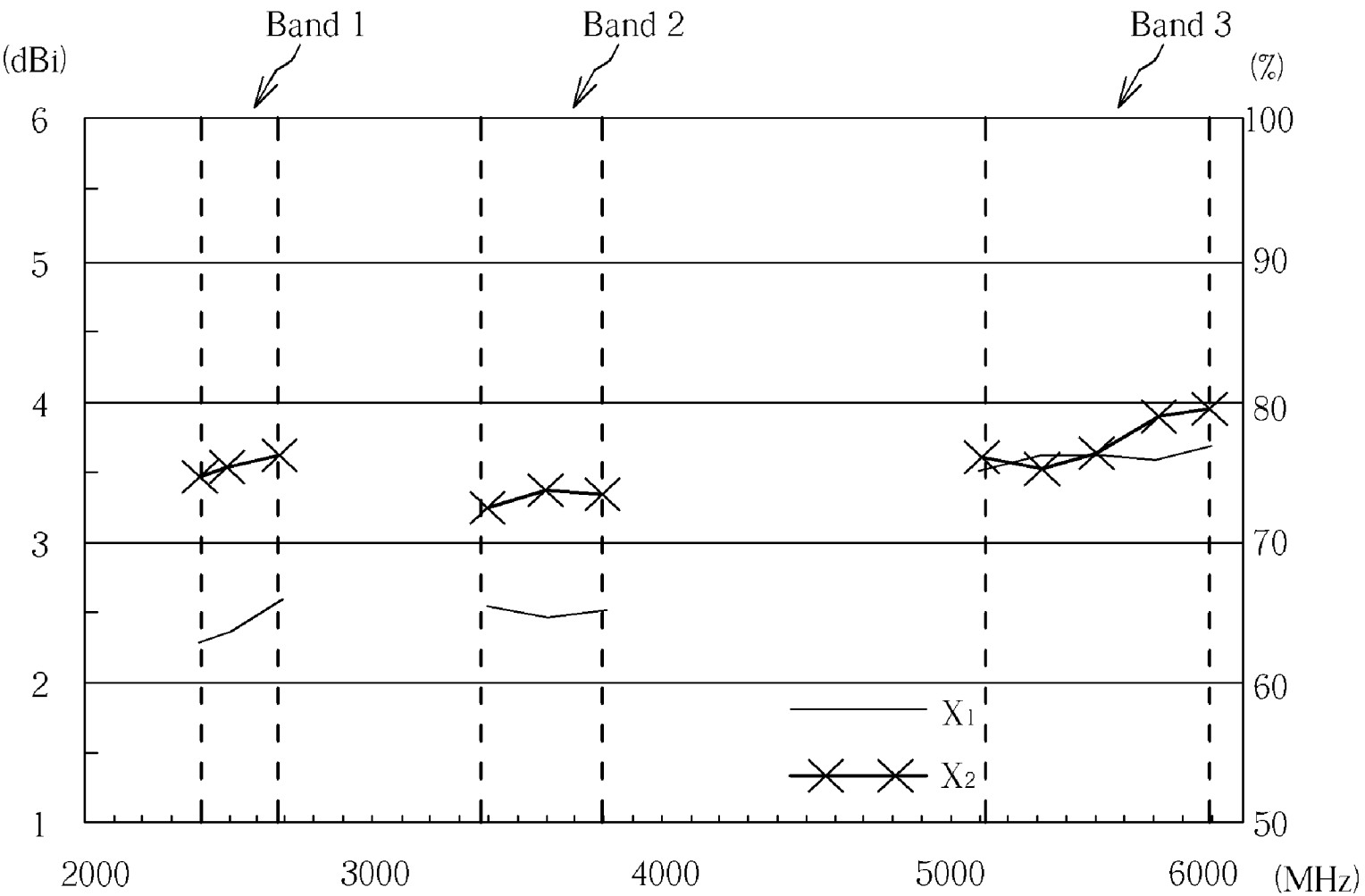
FIG. 9 illustrates the measured peak antenna gain and radiation efficiency of an antenna device according to an embodiment of the present invention.

FIG. 9 illustrates the measured peak antenna gain $X_1$ and radiation efficiency $X_2$ of an antenna device according to an embodiment of the present invention. As shown in FIG. 9, the peak antenna gain $X_1$ is about 2.4, 2.5 and 3.6 dBi over the Bands 1, 2, 3, respectively. Also, the radiation efficiency $X_2$ exceeds about 73% over the WLAN and WiMAX bands.

The meaning and measuring method of the parameters shown in FIGS. 7 to 9 are well known to persons skilled in the art, and it is thus omitted for brevity. From these figures, it is apparent that the antenna device and system according to the present invention have superior advantages and is a novel invention.

With the above-mentioned structures, the lowest operating frequency of an antenna decreases. Also, the size of an antenna is reduced, so that the antenna can be hidden in the system. The above mentioned antenna devices can also be formed by stamping or cutting a single metal plate, decreasing the manufacture cost. Furthermore, good port isolation and wideband operation with good impedance matching can be obtained.

Those skilled in the art will readily observe that numerous modifications and alterations of the device and method may be made while retaining the teachings of the invention.

What is claimed is:

1. An antenna device, comprises:

a first conductive piece, including at least one bending part, a first side, and a second side;

a second conductive piece, electrically coupled to a predetermined voltage level;

a third conductive piece, electrically connected to the first conductive piece and the second conductive piece; and a feeding point, located on the first conductive piece;

wherein the bending part separates the first conductive piece into a first part and a second part, where the second conductive piece is substantially parallel to the first part and is substantially perpendicular to the second part, the first side is electrically connected to the third conductive piece, and the second side is toward the second conductive piece but not electrically connected to the second conductive piece, where the feeding point is located at the second side.

2. The antenna device of claim 1, wherein a distance between the first side and the second side is determined according to a lowest operation frequency of the antenna device.

3. The antenna device of claim 1, wherein the third conductive piece is electrically connected to a part of the first conductive piece and a part of the second conductive piece.

4. The antenna device of claim 1, wherein the second conductive piece and the third conductive piece are formed by stamping or cutting a single metal plate.

5. The antenna device of claim 1, wherein a material with a dielectric constant substantially equal to that of air is provided between the first conductive piece and the second conductive piece.

6. The antenna device of claim 1, wherein the first conductive piece is rectangular, circular, or U-shaped.

7. An antenna system, comprising:

a supporting base, electrically coupled to a predetermined voltage level; and at least one antenna device, located on the supporting base, comprising:

a first conductive piece, including at least one bending part, a first side, and a second side;

a second conductive piece, electrically coupled to the supporting base;

a third conductive piece, electrically connected to the first conductive piece and the second conductive piece; and a feeding point, located on the first conductive piece;

wherein the bending part separates the first conductive piece into a first part and a second part, where the second conductive piece is substantially parallel to the first part and is substantially perpendicular to the second part, the first side is electrically connected to the third conductive piece, and the second side is toward the second conductive piece but not electrically connected to the second conductive piece, where the feeding point is located at the second side.

8. The antenna system of claim 7, wherein the third conductive piece of the antenna device faces a geometric center of the supporting base.

9. The antenna system of claim 7, wherein the antenna system includes a plurality of antenna devices, and the antenna devices are located on the supporting base and are equidistant from each other.

10. The antenna system of claim 7, wherein a distance between the first side and the second side is determined according to a lowest operating frequency of the antenna device.

11. The antenna system of claim 7, wherein the third conductive piece is electrically connected to a part of the first conductive piece and a part of the second conductive piece.

12. The antenna system of claim 7, wherein the second conductive piece and the third conductive piece are formed by stamping or cutting a single metal board.

13. The antenna system of claim 7, wherein a material with a dielectric constant substantially equal to that of air is provided between the first conductive piece and the second conductive piece.

14. The antenna system of claim 7, wherein the first conductive piece is rectangular, circular or U-shaped.

* * * * *